United States Patent [19]

Toth

[11] Patent Number: 4,729,722

[45] Date of Patent: Mar. 8, 1988

[54] NOISE SUPPRESSOR FOR TURBO-COMPRESSOR

[75] Inventor: Dennis W. Toth, Pontiac, Mich.

[73] Assignee: Can-Am Engineered Products, Inc., Livonia, Mich.

[21] Appl. No.: 927,081

[22] Filed: Nov. 5, 1986

[51] Int. Cl.[4] ..... F04B 39/00; F04B 39/16

[52] U.S. Cl. ..... 417/312; 417/313; 417/234; 415/119

[58] Field of Search ..... 417/312, 313, 234, 363, 417/372; 415/119; 181/200

[56] References Cited

U.S. PATENT DOCUMENTS

| | | | |
|---|---|---|---|
| 1,591,522 | 7/1926 | French | 415/119 |
| 4,022,550 | 5/1977 | Brink et al. | 417/312 X |
| 4,302,160 | 11/1981 | Hofmann, Jr. | 417/313 |
| 4,359,085 | 11/1982 | Mueller | 417/312 X |

FOREIGN PATENT DOCUMENTS

| | | | |
|---|---|---|---|
| 203940 | 11/1983 | German Democratic Rep. | 417/312 |
| 28011 | 3/1977 | Japan | 415/119 |
| 1556494 | 11/1979 | United Kingdom | 417/312 |
| 383890 | 9/1973 | U.S.S.R. | 415/119 |

*Primary Examiner*—Carlton R. Croyle
*Assistant Examiner*—Paul F. Neils
*Attorney, Agent, or Firm*—Arnold S. Weintraub

[57] ABSTRACT

A turbo compressor mounted upon a hollow box-like housing is provided with a noise suppressor which includes a rectangular open ended box-like structure suspended from the housing by flexible walled tubes which constitute an air inlet and an air outlet to the housing through which air flows to prevent heat build up within the housing. The suppressor walls are lined with a sound absorbent material which, combined with the non-rigid suspension of the suppressor from the housing and the non-linear air entrance and exit paths to and from the housing, suppresses sound generated by flow of high pressure air from the compressor into the housing through a shaft bearing. Noise generated by the flow of air into the compressor inlet is reduced by blocking the inlet with a block of porous foamed plastic material which also functions as an inlet filter.

5 Claims, 3 Drawing Figures

NOISE SUPPRESSOR FOR TURBO-COMPRESSOR

BACKGROUND OF THE INVENTION

There are presently available industrial spray painting systems in which a turbo-compressor and its associated drive motor are mounted upon a cart so that the unit may be moved about within the plant to the article to be painted.

In units of this type, the motor and turbo-compressor typically are mounted side by side upon a horizontal plate which constitutes the top of the cart with the motor shaft and turbine shaft extending vertically downwardly through their housings and the mounting plate to be coupled to each other by a drive belt located below the mounting plate. Typically, a box-like chamber is provided at the underside of the mounting plate to enclose the shafts and drive belt which are driven at relatively high speed.

In the usual case, the turbo-compressors have multiple stages with the final stage being located at the bottom of the compressor. The chamber which encloses the final stage is defined in part by the bottom of the compressor housing, through which the drive shaft must project. Because of the high speed rotation of the drive shaft, the shaft bearing employed at this last location cannot tightly seal this opening, and in operation of the turbine there is a continuous and relatively high rate of flow of compressed air from the final stage chamber through what is effectively a relatively restricted orifice into the chamber below the mounting plate. This airflow generates a relatively high noise level, frequently in the range of 100 decibels. The chamber into which this air is discharged cannot be sealed because as the air is compressed during its passage through the turbo-compressor, its temperature is also elevated and it is necessary to induce a flow of air through the shaft and drive belt enclosing chamber to prevent an undesirable amount of heat buildup.

The present invention is especially directed to a noise suppressor especially adapted for use in the system described above.

SUMMARY OF THE INVENTION

In accodance with the present invention, an inlet and an outlet opening are formed in the bottom of the box-like chamber underneath the mounting plate. A fan mounted on the drive motor shaft within this chamber is employed to induce a flow of air through the chamber from the inlet to the outlet. A hollow rectangular box-like noise suppressor, open at both ends, is suspended from the bottom wall of the chamber by flexible wall tubes secured to the bottom wall of the chamber, one tube extending from each of the inlet and outlet openings. The lower ends of the tubes are attached to the noise suppressor with openings through the upper wall of the suppressor communicating with the interior of the respective tubes. The internal chamber of the suppressor is divided in half by a wall between the respective openings so that one end of the chamber within the suppressor constitutes an air inlet opening separated by the wall from an air outlet chamber at the opposite end of the suppressor. The interior of the inlet and outlet chambers is lined with a layer of sponge-like foamed plastic material.

In addition to the noise generated by air leakage from the outlet chamber of the turbine through its shaft bearing described above, additional noise is generated at the air intake to the turbine. In accordance with the present invention, sound generated at the air intake is suppressed by mounting within the space between the noise suppressor and the drive shaft and belt enclosing chamber a solid block of foamed polyurethane which is extremely porous and which function both as an inlet filter and a noise suppressor. One or more open ended tubes mounted in and passing through the drive shaft-belt chamber have their lower ends received within the polyurethane block and the upper ends of the tubes, which project above the mounting plate are connected by flexible wall hose to the turbo-compressor inlet(s).

Other objects and features of the invention will become apparent by reference to the following specification and to the drawings.

IN THE DRAWINGS

Figure 1:
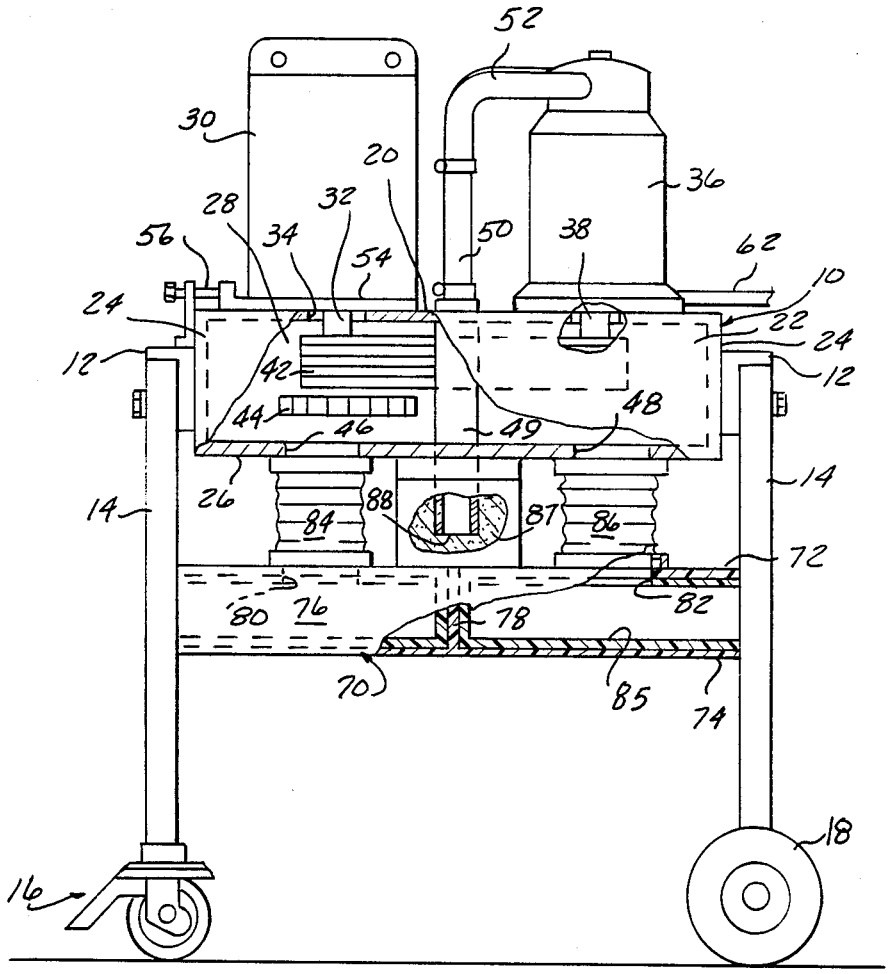
FIG. 1 is a side elevational view, with certain parts broken away or shown in section, of a turbo-compressor air supply system embodying the present invention.
Figure 2:
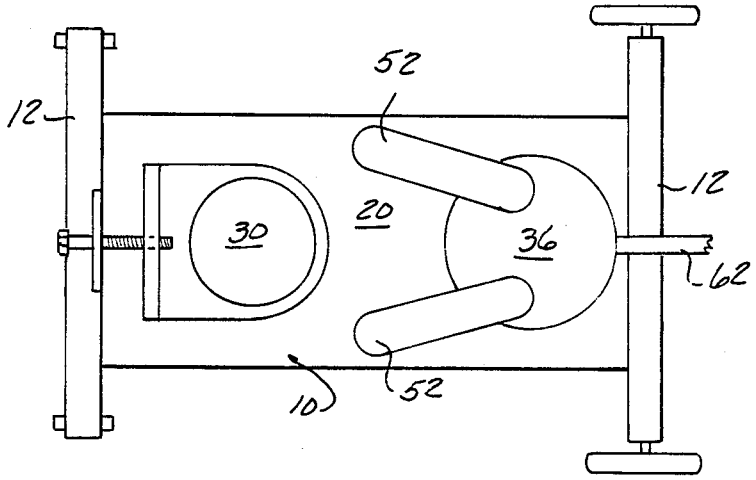
FIG. 2 is a top plan view of the apparatus of FIG. 1.

Referring first to FIGS. 1 and 2 a portable air supply system embodying the present invention includes a hollow box-like housing designated generally 10 having cross frame members 12 fixedly secured to its opposite ends and projecting outwardly beyond the opposite sides of the box as best seen in FIG. 2. From each end of each cross frame member 12, vertical legs project downwardly, one set of legs 14 having caster mounted wheels mounted at the lower end, while the other set of legs 14 rotatably carries a somewhat larger, non-steerable set of wheels 18.

Housing 10 is a simple rectangular box formed with a top wall 20, opposed sidewalls 22, end walls 24 and a bottom wall 26. Bottom wall 26 is removable, being held to the side and end walls 22, 24 by bolts, not shown, to provide access to the chamber 28 within the housing.

Figure 3:
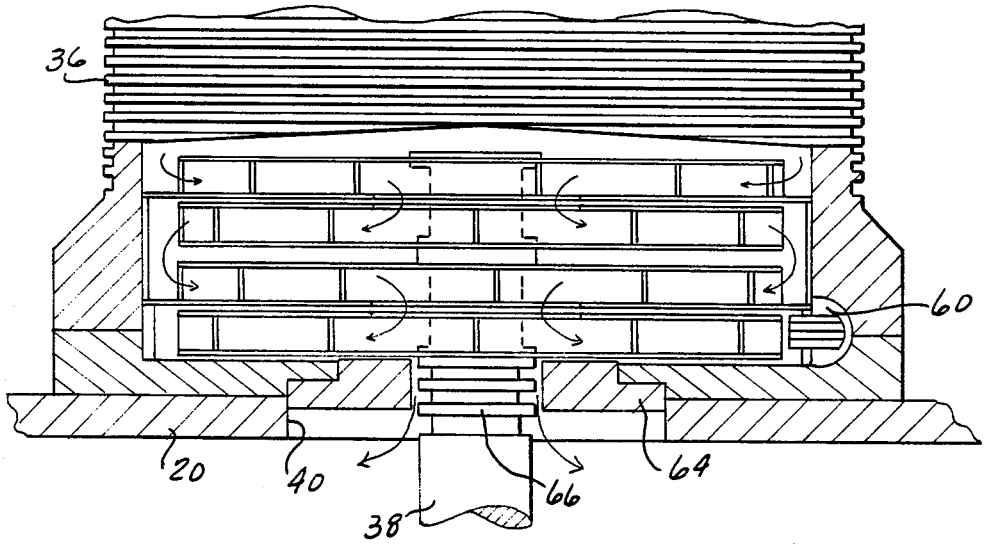
FIG. 3 is a detailed cross-sectional view of the lower portion of the turbo-compressor of FIG. 1.

An electric drive motor 30 is mounted upon the top wall of the housing with its drive shaft 32 disposed vertically and projecting downwardly through an opening 34 in top wall 20. A multi-stage turbo-compressor 36 is also fixedly mounted upon top wall 20 with its drive shaft 38 projecting downwardly through an opening 40 in top wall 20, as best seen in FIG. 3. Rotation of the shaft of drive motor 30 is transmitted to the shaft 38 of turbo compressor 36 by a belt and pulley drive designated generally 42 located within chamber 28. A fan 44 is mounted at the lower end of drive motor shaft 32 for purposes which will be explained below. Bottom wall 26 is formed with two reasonably large openings 46, 48.

A pair of open ended vertically disposed tubular pipes 49 project vertically through housing 10 and are fixedly secured within tightly fitting openings, not shown, in top wall 20 and bottom wall 26 of the housing. A flexible wall tube 50 is clamped to the upper end of each pipe 49 to connect the pipe to extensions 52 of the air inlets to compressor 36.

Drive motor 30 is mounted upon a plate 54 which is slidable relative to top wall 20 of the housing. An adjustment bolt 56 is operable to position the motor longitudinally of the housing to thereby regulate the tension of the drive belt of the belt and pulley drive 42. When the belt tension is adjusted, plate 54 is clamped in position to top wall 20 by bolts not shown.

Referring now particularly to FIG. 3, a cross-sectional view of the lower end of compressor 36 shows the final stages of the multi-stage turbo-compressor with arrows indicating the direction of air flow. Air flowing into the inlet at the upper end of the compressor is accelerated and is increasingly compressed in successive stages as it flows downwardly through the turbine with the final or lowermost stage being located in a chamber at the bottom of the housing which opens into an outlet 60 which is connected to an outlet pipe 62 (FIG. 1) which is in turn connected to a paint spray gun, not shown. As shown in FIG. 3, drive shaft 38 passes through the lower wall of the turbine housing and opening 40 in top plate 20 of housing 10. A plane bearing 64 mounted in the housing cooperates with a series of flanges 66 on the shaft at the location where the shaft passes outwardly from the housing. This bearing, due to the high speed of rotation of shaft 38 cannot be so tight as to provide a fluid tight seal and, during operation of the compressor, a continuous flow of high velocity air from the final stage chamber 60 will pass through this clearance between the flanges 66 and bearing 64, producing a high pitched sound at an undesirably high noise level. The compressing of the air as it passes through the turbo-compressor also heats the air, raising its temperature in the order of 130 to 180 degrees F. above the ambient temperature of air entering the turbine inlet. It is thus desirable to induce a continuous flow of air through chamber 28 of housing 10 to prevent an undesirable buildup of heat within this chamber due to the continuous flow of heated air past bearing 64, 66 into the chamber.

To accommodate this flow of air to remove heat from chamber 28 while at the same time suppressing the noise existing in this chamber, a noise suppressor designated generally at 70 is suspended below housing 10.

Suppressor 70 takes the form of a hollow rectangular open ended box including a top wall 72, bottom wall 74 and two opposed longitudinally extending sidewalls 76.

Suppressor 70 is open at its opposite ends, but its interior is divided into two separate compartments by a central transversely extending wall 78. Top wall 72 of the suppressor is formed with two relatively large diameter openings 80, 82, one at each side of wall 70. The suppressor is suspended from housing 10 by two relatively large diameter flexible wall tubes 84, 86 which are secured to their opposite ends to bottom wall 26 of housing 10 and top wall 72 of suppressor 70 to mechanically suspend the suppressor from housing 10 and at the same time constituting an air flow passage extending from openings 80, 82 in the top wall of the suppressor respectively to openings 46, 48 in the bottom wall of housing 10. This arrangement provides for a continuous flow of ambient air into the open left hand end of suppressor 70 as viewed in FIG. 1, upwardly through opening 80 and tube 84 through opening 46 into housing chamber 28. This air is impelled by fan 44 to the right through chamber 28 to exit the chamber via opening 48, tube 86, opening 82 and the open right hand end of suppressor 70 to carry heated air from chamber 28 and eject this air through the open right hand end of the noise suppressor. The two chambers within suppressor 70 at opposite sides of central wall 78 are lined with a layer of resilient foamed plastic sound absorbing material.

The non-rigid suspension of suppressor 70 from housing 10 provided by the flexible wall conduits 84, 86, the sound absorbtion properties of the resilient foamed plastic layers 85 and the non-linear path from chamber 28 to the exterior of the apparatus cooperatively provide a substantial suppression of the sound generated within chamber 28 by the flow of high velocity air from the compressor past its lower shaft bearing described above.

Sound generated by air flowing into the turbine air inlets is substantially muffled by a porous polyurethane block 78 formed with bores 88 which snugly receive the lower ends of pipes 49 which lead to the turbine air inlet. Block 87 also functions as an efficient air inlet filter.

Where conditions make it desirable, a filter may be placed across the open left hand end of suppressor 70.

Likewise, it is possible to extend the length of the walls 22, 24 of the housing 10 and create a suppressor assembly therewith, thus, rendering housing 10 and suppressor 70 as a unitary member. This would eliminate the need for the conduits 84, 86.

While one embodiment of the invention has been described in detail, it will be apparent to those skilled in the art the diclosed embodiment may be modified. Therefore, the foregoing description is considered exemplary rather than limiting, and true scope of the invention is that defined in the following claims.

I claim:

1. A turbo compressor air supply system for supplying air at relatively low pressure and high volume to a paint spray system or the like, said air supply system comprising a hollow box-like base having a closed internal chamber, a drive motor mounted upon said base and having a drive shaft projecting into said chamber, a turbo compressor including a housing mounted on said base and a drive shaft projecting from said housing into said chamber, drive train means in said chamber coupling said drive shafts to each other to enable said motor to drive said turbo compressor, said turbo compressor housing having air intake means and an air outlet means adapted to be coupled to a paint spray system, said air outlet means being in at least restricted fluid communication with said chamber, noise suppressor means disposed beneath said base, said suppressor means having an inlet compartment having an ambient air inlet and a separate outlet compartment, first means placing said inlet compartment in fluid communication with said chamber, and second means placing said chamber in communication with said outlet compartment.

2. The invention defined in claim 1 further comprising sound absorption means lining the interior of said inlet and outlet compartments.

3. The invention defined in either claim 1 or claim 2 wherein said first means and said second means each comprise a flexible hose suspending and supporting said suppressor means from said base.

4. The invention defined in claim 2 further comprising filter means for filtering air flowing into said air intake means of said turbo compressor.

5. The invention defined in claim 2 wherein said air intake means of said turbo compressor comprises air inlet means in said housing an open ended pipe fixedly mounted in said base and extending through said chamber and having upper and lower ends respectively projecting from the top and bottom of said base, flexible hose means connecting the upper end of said pipe to said air inlet means, and a block of expanded polyurethane foam or the like having a recess therein sealingly receiving the lower end of said pipe to constitute a filter.

* * * * *